US009870888B2

(12) United States Patent
Hahn et al.

(10) Patent No.: US 9,870,888 B2
(45) Date of Patent: Jan. 16, 2018

(54) ELECTRIC SWITCH HAVING AN ELECTROMAGNETIC ACTUATOR

(71) Applicant: Siemens Aktiengesellschaft, Munich (DE)

(72) Inventors: Andreas Hahn, Cottbus (DE); Wolfgang Kuehn, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/306,570

(22) PCT Filed: Apr. 1, 2015

(86) PCT No.: PCT/EP2015/057169
§ 371 (c)(1),
(2) Date: Nov. 18, 2016

(87) PCT Pub. No.: WO2015/165684
PCT Pub. Date: Nov. 5, 2015

(65) Prior Publication Data

US 2017/0110274 A1 Apr. 20, 2017

(30) Foreign Application Priority Data

Apr. 29, 2014 (DE) ..... 10 2014 208 014

(51) Int. Cl.
*H01H 47/04* (2006.01)
*H01H 50/66* (2006.01)
(Continued)

(52) U.S. Cl.
CPC ..... *H01H 47/22* (2013.01); *H01H 47/04* (2013.01); *H01H 50/18* (2013.01);
(Continued)

(58) Field of Classification Search
CPC .. H01H 47/04; H01H 47/22; H01H 2047/046; H01H 50/641; H01H 50/645; H01H 50/66
See application file for complete search history.

(56) References Cited

U.S. PATENT DOCUMENTS 8,159,807 B2 4/2012 Pohl
2010/0019581 A1 1/2010 Pantke et al.

FOREIGN PATENT DOCUMENTS

DE 19544207 A1 6/1997
DE 102008040668 A1 1/2010
(Continued)

OTHER PUBLICATIONS

International Search Report PCT/ISA/210 for International Application No. PCT/EP2015/057169 dated Sep. 25, 2015.
(Continued)

*Primary Examiner* — Ramon M Barrera
(74) *Attorney, Agent, or Firm* — Harness, Dickey & Pierce, P.L.C.

(57) ABSTRACT

A method is disclosed for operating an electric switch having at least one movable switch contact, movable by a movable armature of an electromagnetic actuator to switch the switch on and off, a spring device arranged between the movable switch contact and the armature and, in order to move the armature from a starting position to an armature end position, a magnetic flux being generated in an exciter winding of the actuator by an exciter current being fed into the exciter winding. According to an embodiment and taking into account a position data set which specifies the respective armature position as a function of magnetomotive values and flux values, an armature position—called the contact strike armature position below—is determined at which the switch contacts meet each other during the closing
(Continued)

operation, before the armature reaches the armature end position.

20 Claims, 3 Drawing Sheets

(51) Int. Cl.
*H01H 47/22* (2006.01)
*H01H 50/64* (2006.01)
*H01H 50/18* (2006.01)

(52) U.S. Cl.
CPC ..... *H01H 50/641* (2013.01); *H01H 50/645* (2013.01); *H01H 50/66* (2013.01); *H01H 2047/046* (2013.01); *H01H 2235/01* (2013.01)

(56) References Cited

FOREIGN PATENT DOCUMENTS

| | | | |
|---|---|---|---|
| DE | 102009042777 | A1 | 4/2011 |
| DE | 102011083282 | B3 | 2/2013 |
| WO | WO-2007079767 | A1 | 7/2007 |

OTHER PUBLICATIONS

Written Opinion of the International Searching Authority PCT/ISA/237 for International Application No. PCT/EP2015/057169 dated Sep. 25, 2015.
Office Action for German Application No. 10 2014 208 014.2 dated Feb. 2, 2015.

ELECTRIC SWITCH HAVING AN ELECTROMAGNETIC ACTUATOR

PRIORITY STATEMENT

This application is the national phase under 35 U.S.C. §371 of PCT International Application No. PCT/EP2015/057169 which has an International filing date of Apr. 1, 2015, which designated the United States of America and which claims priority to German patent application number DE 102014208014.2 filed Apr. 29, 2014, the entire contents of which are hereby incorporated herein by reference.

FIELD

An embodiment of invention relates to a method having the features according to the preamble of claim 1.

BACKGROUND

A method is known from the German patent document DE 10 2011 083 282 B3. The patent document describes a method for operating an electric switch having at least one movable switch contact which is moved by a movable armature of an electromagnetic actuator in order switch the switch on and off, wherein a spring device is disposed between the movable switch contact and the armature. In order to move the armature from a predefined starting position, in which the switch contacts are open, into a predefined armature end position, in which the switch contacts are closed and spring energy is stored in the spring device, a magnetic flux is generated in an excitation winding of the actuator by way of an excitation current being fed into the excitation winding.

The German laid-open application DE 195 44 207 A1 describes a control method for an actuator. In this method, in order to control the movement of an armature of the actuator, the displacement variables, i.e., the acceleration, the speed, and the particular location of the armature, are ascertained during the movement of the armature, specifically, inter alia, while evaluating the magnetic flux which flows through an excitation winding of the actuator. Utilizing the calculated displacement variables, a control of the current through the excitation winding takes place with consideration for maintaining a predefined sequence of motions for the actuator.

SUMMARY

An embodiment of the invention includes a method for operating an electric switch, in which the least possible amount of wear occurs.

An embodiment of the invention is directed to a method. Advantageous embodiments of the method according to the invention are described in the claims.

According to a method of an embodiment of the invention, the magnetic flux through the excitation winding, or a flux variable correlating to the magnetic flux through the excitation winding, is determined and a flux value $\Phi ist(t)$ is formed, the magnetomotive force in the excitation winding is determined with consideration for at least the excitation current flowing through the excitation winding and the number of turns of the excitation winding, a magnetomotive value $\Theta(t)$ is determined. And with consideration for a position data set which indicates the particular armature position as a function of magnetomotive values and flux values, an armature position, referred to in the following as the contact strike armature position, is determined at which the switch contacts meet each other during the closing operation, before the armature reaches the armature end position. In order to move the armature from the starting position into the end position, the magnetic flux through the excitation winding is regulated, specifically in such a way that the progression of the flux value $\Phi ist(t)$, in at least one time interval before the armature reaches the contact strike armature position, has a fixedly predefined setpoint flux progression.

An embodiment of the invention also relates to an electric switch having at least one movable switch contact which is moved by a movable armature of an electromagnetic actuator in order to switch the switch on and off, wherein a spring device is disposed between the movable switch contact and the armature and, in order to move the armature from a predefined starting position, in which the switch contacts are open, into a predefined armature end position, in which the switch contacts are closed and spring energy is stored in the spring device, a magnetic flux is generated in an excitation winding of the actuator by way of an excitation current being fed into the excitation winding.

According to a method of an embodiment of the invention, the magnetic flux through the excitation winding, or a flux variable correlating to the magnetic flux through the excitation winding, is determined and a flux value $\Phi ist(t)$ is formed, the magnetomotive force in the excitation winding is determined with consideration for at least the excitation current flowing through the excitation winding and the number of turns of the excitation winding, a magnetomotive value $\Theta(t)$ is determined. And with consideration for a position data set which indicates the particular armature position as a function of magnetomotive values and flux values, an armature position, referred to in the following as the contact strike armature position, is determined at which the switch contacts meet each other during the closing operation, before the armature reaches the armature end position. In order to move the armature from the starting position into the end position, the magnetic flux through the excitation winding is regulated, specifically in such a way that the progression of the flux value $\Phi ist(t)$, in at least one time interval before the armature reaches the contact strike armature position, has a fixedly predefined setpoint flux progression.

One advantage of the method according to an embodiment of the invention is considered to be that the contact strike armature position is determined in this method. This makes it possible to modify a setpoint flux progression, which is fixedly predefined before the contact strike armature position is reached, at the point in time when the contact strike armature position is reached, and to configure the further sequence of motions from the contact strike armature position up to the attainment of the armature end position so as to differ from the sequence of motions taking place before the contact strike armature position is reached. The sequence of motions taking place up to the armature end position may therefore be optimized.

BRIEF DESCRIPTION OF THE DRAWINGS

The invention is explained in greater detail in the following with reference to example embodiments; by way of example

For the sake of clarity, the same reference numbers are always used for identical or comparable components in the figures.

DETAILED DESCRIPTION OF THE EXAMPLE EMBODIMENTS

Figure 1:
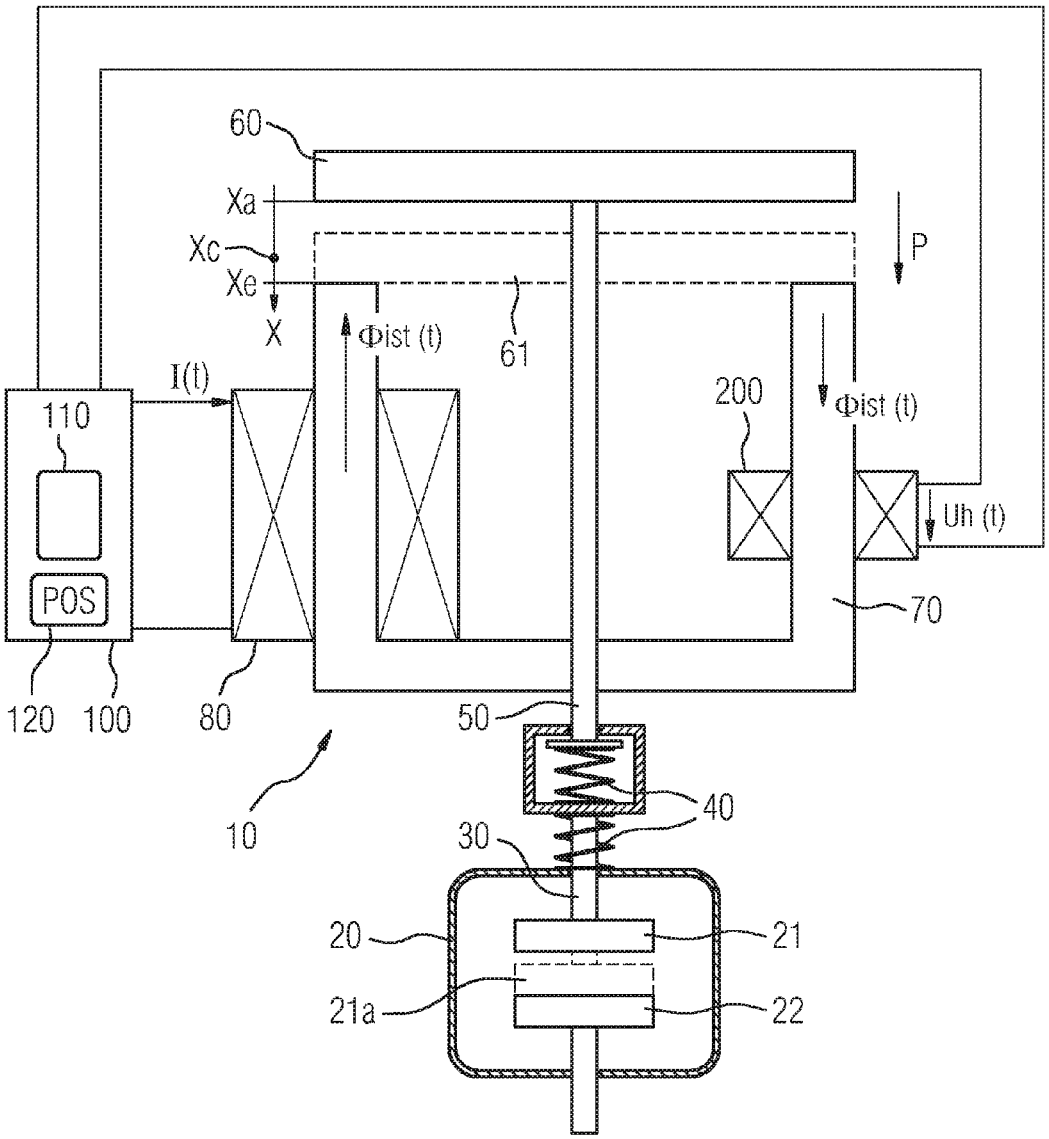
FIG. 1 shows one example embodiment of an arrangement comprising an actuator and an electric switch connected to the actuator, wherein the actuator comprises an excitation winding, a control device, and an auxiliary coil, which is connected to the control device, for measuring the magnetic flux.

The position data set is preferably determined in advance on the basis of calibration measurements, which are carried out at the particular specific switch, and are stored in a memory of the control device. Alternatively, the determination of the position data set can also take place using computer simulation methods which account for the mechanical and electromagnetic properties of the switch.

In terms of carrying out the flux regulation, it is considered to be advantageous when the magnetic flux through the excitation winding is regulated to a predefined constant setpoint flux Φconst1, by way of a constant flux regulation, in the at least one time interval before the armature reaches the contact strike armature position. In other words, it is considered to be advantageous when the fixedly predefined setpoint flux progression in the at least one time interval before the contact strike armature position is reached is a fixedly predefined, constant setpoint flux Φconst1.

The contact strike armature position can be detected particularly rapidly and easily when a magnetomotive value-armature position progression is read out of the position data set for the constant setpoint flux Φconst1, which progression indicates the armature position as a function of the particular magnetomotive force for the constant setpoint flux Φconst1, and the contact strike armature position is determined (at least also) on the basis of the magnetomotive value-armature position progression.

A strike magnetomotive value Θa(Xc), at which the armature reaches the contact strike armature position, is preferably read out of the position data set or the magnetomotive force-armature progression for the constant setpoint flux Φconst1. In this embodiment, the determination of the contact strike armature position preferably takes place on the basis of the strike electromotive value Θa(Xc).

Preferably, the constant flux regulation is terminated or is switched to another setpoint flux (Φconst2) as soon as the armature reaches the contact strike armature position. Preferably, the magnetic flux is reduced by reducing the excitation current flowing through the excitation winding.

In the case of a constant flux regulation before the contact strike armature position is reached, and in the case of accounting for the aforementioned strike magnetomotive value Θa(t), it is considered to be advantageous when the constant flux regulation is terminated or is switched to another setpoint flux (Φconst2) as soon as the magnetomotive value Θ(t) is equal to the strike magnetomotive value Θa(t).

Alternatively or additionally, the particular suitable or approximately suitable position value can be read out of the position data set for the particular determined magnetomotive value and for the particular determined flux value, and the contact strike armature position can be detected on the basis of the position values.

In the latter embodiment, it is considered to be advantageous when the progression of the armature movement is determined from the position data set and time-dependent position information is determined, the time-dependent position information is used for determining time-dependent acceleration information, and the attainment of the contact strike armature position is inferred when the absolute value of the time-dependent acceleration information exceeds or falls below a predefined threshold value.

An embodiment of the invention also relates to an electric switch having at least one movable switch contact which is moved by a movable armature of an electromagnetic actuator in order to switch the switch on and off, wherein a spring device is disposed between the movable switch contact and the armature and, in order to move the armature from a predefined starting position, in which the switch contacts are open, into a predefined armature end position, in which the switch contacts are closed and spring energy is stored in the spring device, a magnetic flux is generated in an excitation winding of the actuator by way of an excitation current being fed into the excitation winding.

In an embodiment of a switch, it is considered to be advantageous when the switch has a control device which determines an armature position—referred to in the following as the contact strike armature position—at which the switch contacts meet each other during the closing operation, before the armature reaches the armature end position, wherein the control device is designed in such a way that the control device determines the magnetic flux through the excitation winding or determines a flux variable correlating to the magnetic flux through the excitation winding, and a flux value Φist(t) is formed, wherein the control device is designed in such a way that the control device determines the magnetomotive force in the excitation winding with consideration for at least the excitation current flowing through the excitation winding and the number of turns of the excitation winding, and a magnetomotive value Θist(t) is formed, wherein the control device is designed in such a way that the control device determines the contact strike armature position with consideration for a position data set stored in a memory of the control device, which data set indicates the particular armature position as a function of magnetomotive values and flux values.

In respect of the advantages of the switch according to an embodiment of the invention, reference is made to the comments presented above in association with the method according to an embodiment of the invention, since the advantages of an embodiment of the method according to the invention correspond to those of the switch according to an embodiment of the invention.

It is considered to be particularly advantageous when the control device is designed such that, to move the armature from the starting position into the armature end position, the control device regulates the magnetic flux through the excitation winding to a constant setpoint flux by way of a constant flux regulation in at least one time interval, before the armature reaches the contact strike armature position.

Preferably, the control device is also designed in such a way that the control device shuts off the constant flux regulation or switches it to another setpoint flux Φconst2 as soon as the armature reaches the contact strike armature position, and reduces the magnetic flux by reducing the excitation current flowing through the excitation winding.

The control device preferably comprises a microprocessor or a microcontroller and the memory, in which the position data set is stored. The microprocessor or the microcontroller is preferably programmed in such a way that it can carry out an embodiment of the above-described method for operating the switch.

FIG. 1 shows an actuator in the form of an electromagnetic drive 10 for an electric switch 20; the switch can be, for example, an electric circuit breaker. The electric switch 20 comprises a movable switch contact 21 and a fixed switch contact 22.

The movable switch contact 21 is connected to a drive rod 30 of the electromagnetic drive 10, which rod cooperates with a spring device 40. In addition, a further drive rod 50 is coupled to the spring device 40, which rod is connected to a movable armature 60 of the electromagnetic drive 10.

The armature 60 can carry out a reciprocating motion along a predefined sliding direction P and thereby move in the direction of a yoke 70 of the drive 10. FIG. 1 shows the armature 60 using solid lines in an open position (also referred to in the following as the starting position), in which the armature is separated from the yoke 70. In the open position of the armature 60, the movable switch contact 21 is situated in an open position which is likewise depicted in FIG. 1 using solid lines. The closed position (also referred to in the following as the end position) of the armature 60, in which the armature rests against the magnetic yoke 70, and the closed position of the movable switch contact are shown using dashed lines and the reference numbers 61 and 21*a*.

The function of the spring device 40 consists of, inter alia, providing a predefined contact pressure in the closed state of the switch 20; in the example embodiment according to FIG. 1, the spring device 40 will press the further drive rod 50 in FIG. 1 upward, and the armature 60 is always acted upon with a spring force which strives to bring the armature into the open position and which must be compensated for in the closed state by a correspondingly great holding force.

Due to the spring device 40, the armature 60 will reach an intermediate position—referred to in the following as the contact strike armature position—during the movement from the starting position into the armature end position, in which the intermediate position the switch contacts meet each other during the closing operation, but the armature has not yet reached the armature end position. The starting position of the armature 60 is labeled in FIG. 1 using the reference character Xa, the contact strike armature position is labeled using the reference character Xc, and the armature end position is labeled using the reference character Xe.

In order to close the electric switch 20 using the electromagnetic drive 10, a current I(t) is fed into the excitation winding 80 via a control device 100, which current induces a magnetic flux within the excitation winding and brings the armature 60 into its closed position in opposition to the spring force of the spring device 40. The control device 100 preferably comprises a microprocessor or a microcontroller 110 which regulates the current I(t), specifically in such a way that the progression of the flux value Φist(t) of the magnetic flux corresponds to a fixedly predefined setpoint flux curve, but only up to the point in time at which the armature 60 reaches the contact strike armature position Xc; this point in time is referred to in the following as the strike instant. Particularly preferably, the magnetic flux through the excitation winding 80 is regulated to a constant setpoint flux Φconst1, by way of a constant flux regulation, in the time interval directly before the strike instant.

In order to make this regulation of the magnetic flux possible, the control device 100 is connected to an auxiliary coil 200 which encloses the magnetic yoke 70 and through which the same magnetic flux flows as flows through the excitation winding 80. The control device 100 or its microcontroller 110 measures the electric voltage Uh(t) dropping at the auxiliary coil 200, and forms a measured coil voltage value and, on the basis thereof and with consideration for the law of induction:

$$Uh(t)=N\cdot d\Phi ist(t)/dt$$

determines the magnetic flux which permeates the excitation winding 80 and the auxiliary coil 200; in the formula, N represents the number of turns of the auxiliary coil 200, Uh(t) represents the voltage dropping at the auxiliary coil 200, and t represents time.

With consideration for the particular flux value Φist(t), the microcontroller 110 of the control device 100 controls the current I(t) through the excitation winding 80 in such a way that the flux value Φist(t) of the magnetic flux has a predefined progression over time, before the armature reaches the contact strike armature position. In other words, the regulation of the actuator movement or the regulation of the movement of the armature 60 initially takes place independently of its actual movement parameters, and, in fact, exclusively on the basis of the flux value Φist(t) of the magnetic flux which permeates the excitation winding 80 and the auxiliary coil 200, specifically for the period of time until the armature 60 reaches the contact strike armature position.

In order to provide for a shutoff of the setpoint flux regulation or a switchover of the setpoint flux regulation to a setpoint flux other than the setpoint flux Φconst1 when or as soon as the armature 60 reaches the contact strike armature position Xc, the control device 100 additionally determines the magnetomotive force in the excitation winding 80 during the movement of the armature, for example, with consideration for the excitation current I(t) flowing through the excitation winding and the number of turns W of the excitation winding 80, and forms a magnetomotive value Θ(t), preferably according to $$\Theta(t)=W\cdot I(t)$$

The magnetomotive force therefore corresponds to the magnetic voltage as a line integral of the magnetic field strength in a closed magnetic circuit.

With consideration for a position data set POS which is stored in a memory 120 of the control device 100 and indicates the particular armature position X as a function of magnetomotive values Θ(t) and the magnetic flux values Φist(t), the microcontroller 110 can determine the contact strike armature position Xc at which the switch contacts meet each other during the closing operation, before the armature 60 reaches the armature end position.

Figure 4:
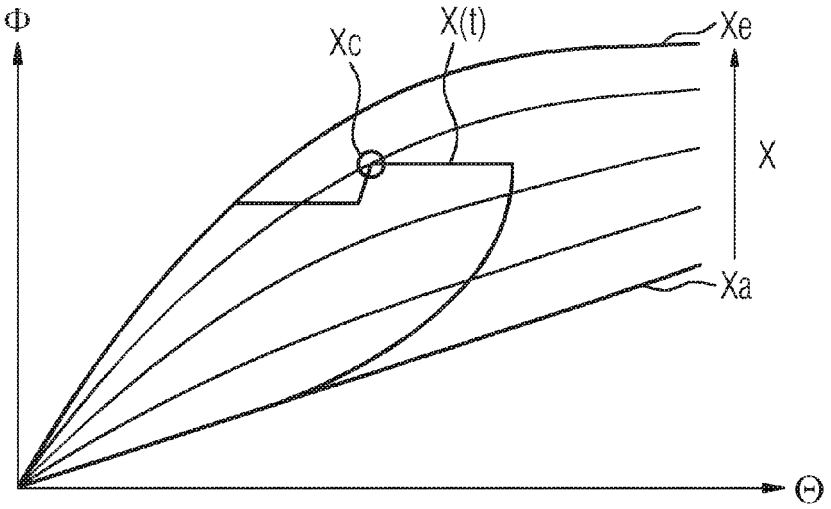
FIG. 4 shows one example embodiment of a position data set in the form of a family of characteristics.

One example embodiment of a family of characteristics which can form the position data set POS in the memory 120 of the control device 100 is shown in FIG. 4 by way of example. As is apparent, there is a multiplicity of functions having the form $$\Phi=f(\Theta)$$

for different armature positions X, wherein the starting position, in which the switch contacts are open, is labeled with the reference character Xa, and the armature end position, in which the switch contacts are closed and the spring energy is stored in the spring device 40, is labeled with the reference character Xe. The curve X(t) shows, by way of example, one possible armature progression over time through the family of characteristics during the movement from the starting position Xa through the contact strike armature position Xc into the armature end position Xe.

If a constant flux regulation takes place by way of the control device 80 in such a way that the flux value Φist(t) has the constant setpoint flux Φconst1 before the contact strike armature position Xc is reached, the control device 80 or its microcontroller 110 can read out, from the position data set POS for the constant setpoint flux Φconst1, or form a magnetomotive value-armature position progression Θa(X) which indicates the armature position X as a function of the particular magnetomotive value Θ(t) for the constant setpoint flux Φconst1. On the basis of this magnetomotive value-armature position progression Θa(X), the control device 80 or its microcontroller 110 can therefore read out the strike magnetomotive value Θa(Xc) for which the armature 60 reaches the contact strike armature position Xc.

As soon as the control device 80 establishes that the magnetomotive value Θ(t) is equal to the strike magnetomotive value Θa(Xc), the device infers that the armature 60 has reached the contact strike armature position Xc and reduces the magnetic flux ΦIst(t) by reducing the excitation current I(t) flowing through the excitation winding. Such a reduction of the magnetic flux can take place, for example, by switching the constant flux regulation to another, i.e., lower, setpoint flux Φconst2.

Figure 2:
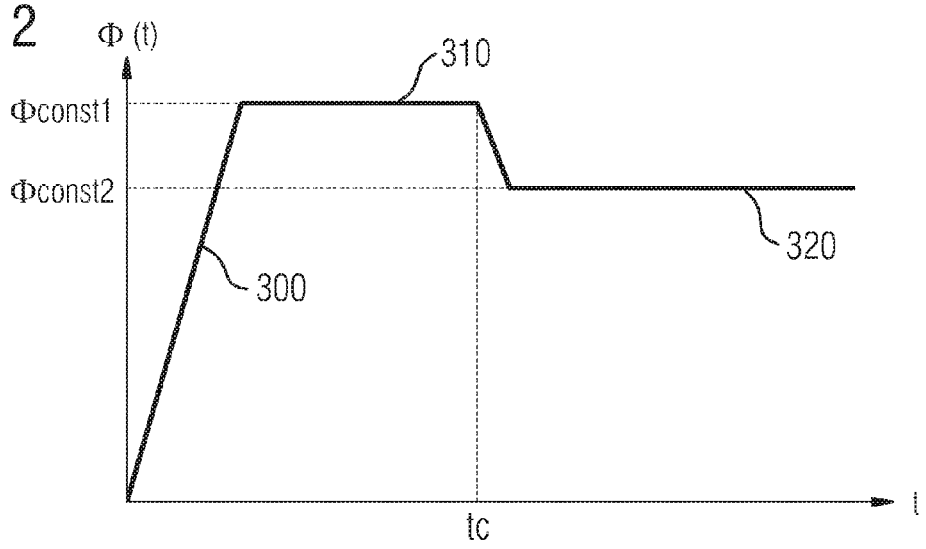
FIG. 2 shows one first example embodiment of a setpoint flux curve, to which the control device according to FIG. 1 can regulate the magnetic flux.

FIG. 2 shows one example embodiment of a flux curve having flux values Φ(t) over time t, which the microcontroller 110 can adjust in order to control the excitation winding 80. As is apparent, the flux curve according to FIG. 2 has a rising ramp section 300, in which the flux values Φ(t) increase preferably linearly from 0 to a predefined ramp end value.

Adjoining the rising ramp section 300 is a first constant flux section 310, in which the magnetic flux has a first constant setpoint flux Φconst1 due to constant flux regulation. The first constant flux section 310 is used for inducing particularly great acceleration forces in the initial phase of the acceleration of the movable armature 60, in order to particularly rapidly increase the speed of the armature 60 in the initial phase.

As soon as the armature 60 has reached the contact strike armature position Xc at the point in time tc, the setpoint flux regulation is switched, specifically to a constant second setpoint flux Φconst2 which is suitable for holding the armature 60 in the armature end position. A second constant flux section results, which is labeled in FIG. 2 using reference number 320.

Figure 3:
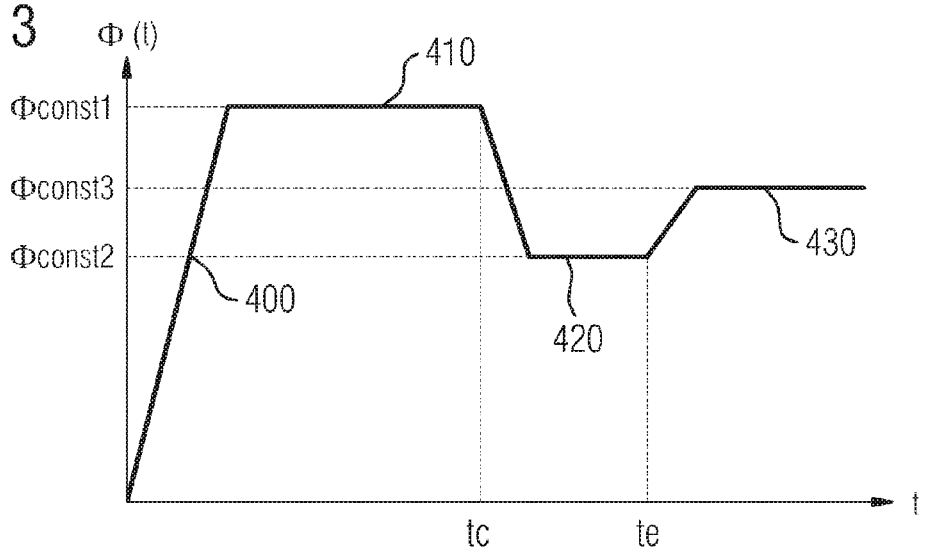
FIG. 3 shows one second example embodiment of a setpoint flux curve, to which the control device according to FIG. 1 can regulate the magnetic flux.

FIG. 3 shows one further example embodiment of a flux curve having flux values Φ(t) over time t, which the microcontroller 110 can adjust in order to control the excitation winding 80. As is apparent, there is a rising ramp section 400, a first constant flux section 410 having a first constant setpoint flux Φconst1, a second constant flux section 420 having a second constant setpoint flux Φconst2, and a third constant flux section 430 having a third constant setpoint flux Φconst3.

The second constant flux section 420 functions as a brake section and is chronologically situated between the first constant flux section 410 functioning as the acceleration section and the third constant flux section 430 which is suitable for holding the armature 60 in the armature end position. The second constant flux section 420 is used for allowing the speed of the armature 60 to decrease—before the impact on the magnetic yoke 70—to a value which ensures the least possible amount of wear of the actuator parts of the actuator 10. In the second constant flux section 420, the constant setpoint flux Φconst2 is preferably less than the third constant setpoint flux Φconst3, with which the armature 60 can be held in its end position against the yoke 70.

The switchover of the constant flux regulation for the transition from the first constant flux section 410 into the second constant flux section 420 preferably takes place when the armature 60 has reached the contact strike armature position Xc at the point in time te. The contact strike armature position Xc is detected by the microcontroller 110 preferably on the basis of the position data set POS.

The switchover of the constant flux regulation for the transition from the second constant flux section 420 into the third constant flux section 430 preferably takes place when the armature has reached the armature end position Xe at the point in time te. The armature end position Xe is detected by the microcontroller 110 preferably on the basis of the position data set POS, which is stored in the memory 120 of the control device 100, as a function of the magnetomotive values Θ(t) and the magnetic flux values Φist(t), i.e., for example, in the same way that the microcontroller determines the contact strike armature position Xc as a function of the magnetomotive values Θ(t) and the magnetic flux values Φist(t). The aforementioned comments apply similarly in respect of the detection of the armature end position Xe.

Alternatively, the control device 100 or its microcontroller 110 can also determine the contact strike armature position Xc and/or the armature end position Xe as follows:

Initially, the particular suitable or approximately suitable position value X(t) of the armature 60 is read out of the position data set POS for the particular determined magnetomotive value Θ(t) and for the particular determined flux value ΦIst(t). On the basis of the time-dependent position information, time-dependent acceleration information a(t) is determined according to $$a(t) = \frac{d^2X(t)}{dt^2},$$

and it is inferred that the contact strike armature position Xc or the armature end position Xe has been reached when the absolute value |a(t)| of the time-dependent acceleration information a(t) reaches or exceeds a predefined threshold value M, i.e., when the following applies:

$$|a(t)| \geq M$$

Moreover, the aforementioned comments apply similarly in respect of the mode of operation of the control device 100 and its microcontroller 110.

Figure 5:
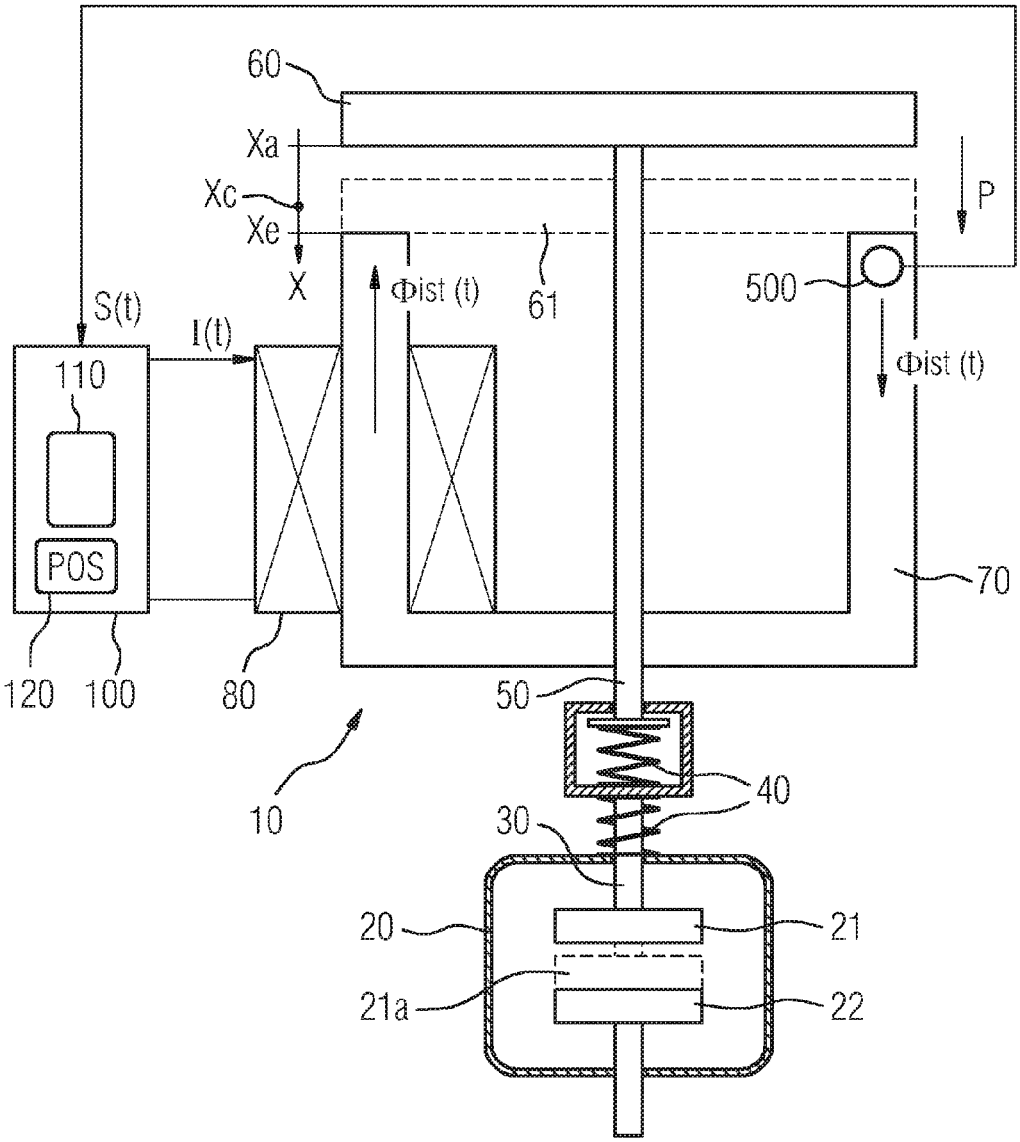
FIG. 5 shows one example embodiment of an arrangement comprising an actuator and an electric switch, wherein the actuator comprises an excitation winding, a control device, and a Hall sensor, which is connected to the control device, for measuring the magnetic flux.

FIG. 5 shows a second example embodiment of an actuator 10 and an electric switch 20, in which a control device 100 of the actuator 10 induces a regulation of the flux value Φist(t) of the magnetic flux through the yoke 70 and the associated movable armature 60. The arrangement according to FIG. 5 essentially corresponds to the example embodiment according to FIG. 1 in terms of design, with the difference that a Hall sensor 500 rather than an auxiliary coil is provided for measuring the flux value Φist(t), which Hall sensor is connected to the control device 100 and the microcontroller 110. The Hall sensor 500 generates a measuring signal S(t) which is transmitted from the Hall sensor 500 to the control device 100 and to the microcontroller 110. On the basis of the measuring signal S(t), the microcontroller 110 can determine the magnetic flux in the magnetic yoke 70 or the magnetic flux through the excitation winding 80 and adjust the current I(t) through the excitation winding 80 in such a way that the magnetic flux in the excitation winding 80 or in the magnetic yoke 70 corresponds to a predefined setpoint flux curve in terms of the shape of the curve over time, as was shown above, by way of example, in association with FIGS. 2 through 4.

In summary, the example embodiment according to FIG. 5 therefore differs from the example embodiment according to FIG. 1 merely in terms of the detection of the flux value Φist(t) of the magnetic flux which flows through the excitation winding 80, the magnetic yoke 70, and the armature 60.

Although the invention was illustrated and described in greater detail by way of preferred example embodiments, the invention is not restricted by the disclosed examples, and other variations can be derived therefrom by a person skilled in the art, without departing from the scope of protection of the invention.

LIST OF REFERENCE NUMBERS

10 Electromagnetic drive/actuator
20 Switch
21 Movable switch contact
21*a* Switch contact in closed position/end position
22 Fixed switch contact
30 Drive rod
40 Spring device
50 Further drive rod
60 Armature
61 Armature in closed position/end position
70 Yoke
80 Excitation winding
100 Control device
110 Microcontroller
120 Memory
200 Auxiliary coil
300 Rising ramp section
310 First constant flux section
320 Second constant flux section
400 Rising ramp section
410 First constant flux section
420 Second constant flux section
430 Third constant flux section
500 Hall sensor
I(t) Coil current
P Sliding direction
POS Position data set
S(t) Measuring signal
t Time
tc Point in time
te to Point in time
Uh(t) Voltage
X Armature position
Xa Starting position
Xc Contact strike armature position
Xe Armature end position
X(t) Time-dependent position information
Φist (t) Flux value
Φ(t) Flux value
Φconst1 Setpoint flux
Φconst2 Setpoint flux
Φconst3 Setpoint flux
Θ Magnetomotive force

The invention claimed is:

1. A method for operating an electric switch including at least one movable switch contact configured to be moved by a movable armature of an electromagnetic actuator to switch the switch on and off, a spring device being disposed between the movable switch contact and the armature, and, in order to move the armature from a starting position, in which the switch contacts are open, into an armature end position, in which the switch contacts are closed and spring energy is stored in the spring device, a magnetic flux is to be generated in an excitation winding of the actuator via an excitation current being fed into the excitation winding, the method comprising:

determining the magnetic flux through the excitation winding or a flux variable correlating to the magnetic flux through the excitation winding, and forming a flux value;

determining the magnetomotive force in the excitation winding with consideration for at least the excitation current flowing through the excitation winding and a number of turns of the excitation winding, and forming a magnetomotive value; and determining an armature position, with consideration for a position data set which indicates a particular armature position as a function of magnetomotive values and flux values, referred to as a contact strike armature position, at which the switch contacts meet each other during the closing operation, before the armature reaches the armature end position; and regulating the magnetic flux through the excitation winding, to move the armature from the starting position into the end position.

2. The method of claim 1, wherein the magnetic flux through the excitation winding is regulated to a constant setpoint flux, by way of a constant flux regulation, in the at least one time interval before the armature reaches the contact strike armature position.

3. The method of claim 2, further comprising:

reading a magnetomotive value-armature position progression out of the position data set for the constant setpoint flux, the position progression indicating the armature position as a function of the magnetomotive force for the constant setpoint flux; and determining the contact strike armature position at least also on the basis of the magnetomotive value-armature position progression.

4. The method of claim 3, further comprising:

reading a strike magnetomotive value, at which the armature reaches the contact strike armature position, out of the position data set or the magnetomotive force-armature progression for the constant setpoint flux, wherein the determination of the contact strike armature position also takes place at least on the basis of the strike magnetomotive value.

5. The method of claim 2, further comprising:

terminating the constant flux regulation or switching the constant flux regulation to another setpoint flux as soon as the armature reaches the contact strike armature position, by way of the magnetic flux being reduced by reducing the excitation current flowing through the excitation winding.

6. The method claim 2, wherein the constant flux regulation is terminated or is switched to another setpoint flux as soon as the magnetomotive value is equal to the strike magnetomotive value.

7. The method of claim 1, wherein the particular suitable or approximately suitable position value is read out of the position data set for the particular determined magnetomotive value and for the particular determined flux value, and wherein the contact strike armature position is detected on the basis of the position values.

8. The method of claim 1, further comprising:

determining the progression of the movement of the armature from the position data set, determining time-dependent position information, the time-dependent position information being used for determining time-dependent acceleration information, and inferring that the contact strike armature position has been reached when the absolute value of the time-dependent acceleration information reaches or exceeds a threshold value.

9. The method of claim 1, wherein the regulating of the magnetic flux through the excitation winding, to move the armature from the starting position into the end position, is done in such a way that the progression of the flux value, in at least one time interval before the armature reaches the contact strike armature position, has a fixed setpoint flux progression.

10. The method of claim 9, wherein the magnetic flux through the excitation winding is regulated to a constant setpoint flux, by way of a constant flux regulation, in the at least one time interval before the armature reaches the contact strike armature position.

11. The method of claim 10, further comprising:

reading a magnetomotive value-armature position progression out of the position data set for the constant setpoint flux, the position progression indicating the armature position as a function of the magnetomotive force for the constant setpoint flux, and determining the contact strike armature position at least also on the basis of the magnetomotive value-armature position progression.

12. The method of claim 2, further comprising:

reading a strike magnetomotive value, at which the armature reaches the contact strike armature position, out of the position data set or the magnetomotive force-armature progression for the constant setpoint flux, wherein the determination of the contact strike armature position also takes place at least on the basis of the strike magnetomotive value.

13. The method of claim 10, further comprising:

reading a strike magnetomotive value, at which the armature reaches the contact strike armature position, out of the position data set or the magnetomotive force-armature progression for the constant setpoint flux, wherein the determination of the contact strike armature position also takes place at least on the basis of the strike magnetomotive value.

14. The method of claim 11, further comprising:

reading a strike magnetomotive value, at which the armature reaches the contact strike armature position, out of the position data set or the magnetomotive force-armature progression for the constant setpoint flux, wherein the determination of the contact strike armature position also takes place at least on the basis of the strike magnetomotive value.

15. An electric switch comprising:

at least one movable switch contact, movable by a movable armature of an electromagnetic actuator to switch the switch on and off;

a spring device, disposed between the at least one movable switch contact and the movable armature, wherein a magnetic flux is generatable in an excitation winding of an actuator by way of an excitation current being fed into the excitation winding, to move the movable armature from a starting position in which the at least one movable switch contact and another switch contacts are open, into an armature end position, in which switch contacts, including the at least one movable switch contact and the another contact, are closed and spring energy is stored in the spring device; and a control device to determines an armature position, referred to as a contact strike armature position, at which the switch contacts meet each other during the closing operation, before the armature reaches the armature end position, determines the magnetic flux through the excitation winding or determines a flux variable correlating to the magnetic flux through the excitation winding, and form a flux value, determines the magnetomotive force in the excitation winding with consideration for at least the excitation current flowing through the excitation winding and a number of turns of the excitation winding, and form a magnetomotive value, and determines the contact strike armature position with consideration for a position data set stored in a memory of the control device, the data set indicating a particular armature position as a function of magnetomotive values and flux values.

16. The switch of claim 15, wherein the control device is further designed to, in order to move the armature from the starting position into the armature end position, regulates the magnetic flux through the excitation winding to a constant setpoint flux by way of a constant flux regulation in at least one time interval, before the armature reaches the contact strike armature position.

17. The switch of claim 16, wherein the control device is further designed to shut off the constant flux regulation or switches the constant flux regulation to another setpoint flux as soon as the armature reaches the contact strike armature position, and to reduces the magnetic flux by reducing the excitation current flowing through the excitation winding.

18. The switch claim 15, wherein the control device comprises a microprocessor or a microcontroller and the memory, in which the position data set is stored, and wherein the microprocessor or the microcontroller is programmed to carry out the determining of the an armature position, the magnetic flux, the magnetomotive force and the contact strike armature position and the forming of the flux value and the magnetomotive value.

19. The switch of claim 16, wherein the control device comprises a microprocessor or a microcontroller and the memory, in which the position data set is stored, and wherein the microprocessor or the microcontroller is programmed to carry out the determining of the an armature position, the magnetic flux, the magnetomotive force and the contact strike armature position, the forming of the flux value and the magnetomotive value, and the regulating of the magnetic flux.

20. The switch of claim 17, wherein the control device comprises a microprocessor or a microcontroller and the memory, in which the position data set is stored, and wherein the microprocessor or the microcontroller is programmed to carry out the determining of the an armature position, the magnetic flux, the magnetomotive force and the contact strike armature position the forming of the flux value and the magnetomotive value, the regulating of the magnetic flux, the shutting off of the constant flux regulation or switching of the constant flux regulation to another setpoint flux, and the reducing of the magnetic flux.

* * * * *